US010612774B2

(12) United States Patent
Takeuchi et al.

(10) Patent No.: US 10,612,774 B2
(45) Date of Patent: Apr. 7, 2020

(54) TOTALLY PRIMARY AIR COMBUSTION TYPE OF BURNER

(71) Applicant: RINNAI CORPORATION, Aichi (JP)

(72) Inventors: Masaru Takeuchi, Nagoya (JP); Takashi Ojiro, Nagoya (JP); Takahiro Ono, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 201 days.

(21) Appl. No.: 15/908,954

(22) Filed: Mar. 1, 2018

(65) Prior Publication Data

US 2018/0259181 A1 Sep. 13, 2018

(30) Foreign Application Priority Data

Mar. 13, 2017 (JP) ..... 2017-047463

(51) Int. Cl.
*F23D 14/14* (2006.01)
*F23D 14/84* (2006.01)
*F23D 14/74* (2006.01)

(52) U.S. Cl.
CPC ..... *F23D 14/145* (2013.01); *F23D 14/74* (2013.01); *F23D 14/84* (2013.01)

(58) Field of Classification Search
CPC ..... F23D 14/14
USPC ..... 431/326, 7, 10
See application file for complete search history.

(56) References Cited

U.S. PATENT DOCUMENTS 6,561,795 B1 * 5/2003 Lasagni ..... F23D 14/105 239/556
7,201,572 B2 * 4/2007 Wood ..... C04B 35/565 264/109
2008/0081306 A1 * 4/2008 Chung ..... A47J 37/0713 431/326
2013/0337390 A1 * 12/2013 Akagi ..... F23D 14/58 431/328

* cited by examiner

*Primary Examiner* — Avinash A Savani
(74) *Attorney, Agent, or Firm* — Cermak Nakajima & McGowan LLP; Tomoko Nakajima

(57) ABSTRACT

A totally primary air combustion type of burner has a combustion plate with a plurality of slit-shaped flame holes for ejecting therethrough air-fuel mixture for combustion. The combustion plate has a plurality of flame-hole rows having flame holes arranged in an X-axis (longitudinal) direction at a predetermined pitch in a Y-axis (lateral or shorter) direction. First flame-hole rows with position of flame holes and second flame-hole rows with position of flame holes with deviation by half a pitch in the Y-axis direction, are alternately arrayed in parallel with one another in the X-axis direction. A plurality of positions in the Y-axis direction of one of the first and the second flame-hole rows are provided with thinned portions (portions where no flame holes are formed) so that the pitch between the flame holes becomes two times the predetermined pitch.

4 Claims, 7 Drawing Sheets

TOTALLY PRIMARY AIR COMBUSTION TYPE OF BURNER

BACKGROUND OF THE INVENTION

1. Technical Field

The present invention relates to a totally primary air combustion type of burner which is provided with a combustion plate to cover an air-fuel mixture ejection part of a burner body, and in which air-fuel mixture is ejected for combustion out of a multiplicity of slit-shaped flame holes formed in the combustion plate.

This kind of burner is conventionally known in JP-2014-9838A in which, provided that a longitudinal (longer-side) direction of a flame hole is defined as an X-axis direction and that a lateral (shorter-side) direction is defined as a Y-axis direction, a plurality of flame-hole rows, each row being made up of a plurality of flame holes arrayed at a predetermined pitch in the Y-axis direction, are arranged in the combustion plate in parallel with one another in the X-axis direction. In this arrangement, however, the positions of the flame holes in the Y-axis direction are in alignment with all of the flame-hole rows.

Further, in this arrangement, in a plurality of positions in the X-axis direction of the combustion plate, there are provided thinned portions in which about two rows of flame-hole rows are thinned (i.e., not provided) so that the spacing in the X-axis direction among the flame-hole rows becomes wider. According to this arrangement, the thinned portions become recirculation regions of the air-fuel mixture and, as a result, flame holding effect can be obtained.

However, when thinned portions of the flame-hole rows are provided as explained above, the area of the portions for forming the flame-hole rows becomes smaller. In this arrangement, at the time of high intensity combustion, the air-fuel mixture will be ejected in a concentric manner through the portions in which the flame-hole rows are formed, thus resulting in a prolonged flame. Therefore, in order to keep the flame out of contact with an object to be heated, it is necessary to increase the distance between the burner and the object to be heated, resulting in an enlarged combustion apparatus.

SUMMARY

Problems that the Invention is to Solve

In view of the above points, this invention has an advantage of providing a totally primary air combustion type of burner in which flame holding effect can be obtained without giving rise to too large flames at the time of high intensity combustion.

Means for Solving the Problems

In order to solve the above problem, this invention has a feature in that there is provided a totally primary air combustion type of burner which is provided with a combustion plate to cover an air-fuel mixture ejection part of a burner body, and in which air-fuel mixture is ejected for combustion out of a multiplicity of slit-shaped flame holes formed in the combustion plate. Provided that a longitudinal direction of each flame hole is defined as an X-axis direction, and that a lateral direction thereof is defined as a Y-axis direction, the combustion plate has a plurality of flame-hole rows, each row being constituted by a plurality of flame holes arranged in the Y-axis direction at a predetermined pitch, the plurality of flame-hole rows being arrayed in the X-axis direction in parallel with one another. The flame-hole rows are made up of first flame-hole rows, and second flame-hole rows. The position of each flame hole of the second flame-hole rows is offset in the Y-axis direction by half a pitch from the position of each flame hole of the first flame-hole rows. The first flame-hole rows and the second flame-hole rows are arranged alternately in the X-axis direction in parallel with one another. At least one of the first flame-hole rows and the second flame-hole rows has, in a plurality of places in the Y-axis direction, thinned portions in which one piece each of flame hole is thinned so that the pitch between the flame holes becomes two times the predetermined pitch. Each of the thinned portions is enclosed by a total of six flame holes constituted by: two flame holes belonging to the flame-hole row in which the said thinned portion is disposed, and also positioning on both sides, in the Y-axis direction, of the said thinned portion; two flame holes belonging to a flame-hole row positioned on one side, in the X-axis direction, of the flame-hole row in which the said thinned portion is disposed, and also being respectively deviated by half a pitch to both sides, in the Y-axis direction, relative to a center of the said thinned portion; and two flame holes belonging to a flame-hole row positioned on an opposite side, in the X-axis direction, of the flame-hole row in which the said thinned portion is disposed, and also being respectively deviated by half a pitch to both sides, in the Y-axis direction, relative to the center of the said thinned portion.

According to this invention, the air-fuel mixture ejected out of the six flame holes that enclose the thinned portion will be partly recirculated to the thinned portion to thereby surely obtain the flame holding effect. And, unlike the conventional example in which the flame-hole rows themselves are thinned, according to this invention only a flame hole is thinned at each of the plurality of places in the Y-axis direction in at least one of the flame-hole rows between the first flame-hole row and the second flame-hole row. Therefore, the air-fuel mixture will be ejected substantially uniformly over the entire combustion plate. As a consequence, the air-fuel mixture will not be ejected in a concentric manner out of the combustion plate. The flame will thus be not enlarged even at the time of high intensity combustion. As a result, the distance between the burner and the object to be heated need not be increased, whereby the combustion apparatus can be prevented from getting large in size.

Provided that such a portion of the combustion plate as is overlapped with the air-fuel mixture ejection part is defined as a combustion region, in the portion that is near a side edge, on an outside, in the X-axis direction of the combustion region, the heat will be deprived by the surrounding. Therefore, the flame holding performance is likely to become poor. As a solution, in this invention, provided that, out of the first flame-hole rows and the second flame-hole rows, the flame-hole row that is near the side edge on the outside, in the X-axis direction, of the combustion region is defined as an outside flame-hole row, preferably the outside flame-hole row is free from disposition of the thinned portions (i.e., the thinned portions are not disposed). According to this arrangement, the flame holding performance can be secured in the portion near the side edge of the outside, in the X-axis direction, of the combustion region;

Further, according to this invention, preferably a discharging gap between those ignition electrode and grounding electrode which are disposed to face the combustion plate lies opposite to that predetermined portion between the flame holes which belongs to one of the first flame-hole rows and the second flame-hole rows and which is other than the thinned portion and also an ignition flame hole which is smaller than the flame holes is disposed in the predetermined portion between the flame holes. According to this arrangement, even if the position of the discharging gap may slightly fluctuate, the air-fuel mixture is supplied from the ignition flame hole to the discharging gap. The ignition characteristics can therefore be secured. Further, by making the ignition flame hole smaller, throwing off balance of the heat distribution due to addition of the ignition flame hole can be prevented.

Still furthermore, in this invention, a heat-resistant fabric may be laminated on a surface of that side of the combustion plate out of which the air-fuel mixture is ejected. According to this arrangement, the air-fuel mixture comes to be ejected out of the flame holes through the heat-resistant canvas. Therefore, the flow velocity distribution, in the Y-axis direction, of the air-fuel mixture with the flame hole being in the center will become gradual. Therefore, flame will be formed, though small in quantity, also in the thinned portion. As a result, the flame holding performance can be increased and the characteristics of lifting resistance of the flames can be improved.

PREFERRED EMBODIMENTS FOR CARRYING OUT THE INVENTION

Figure 1:
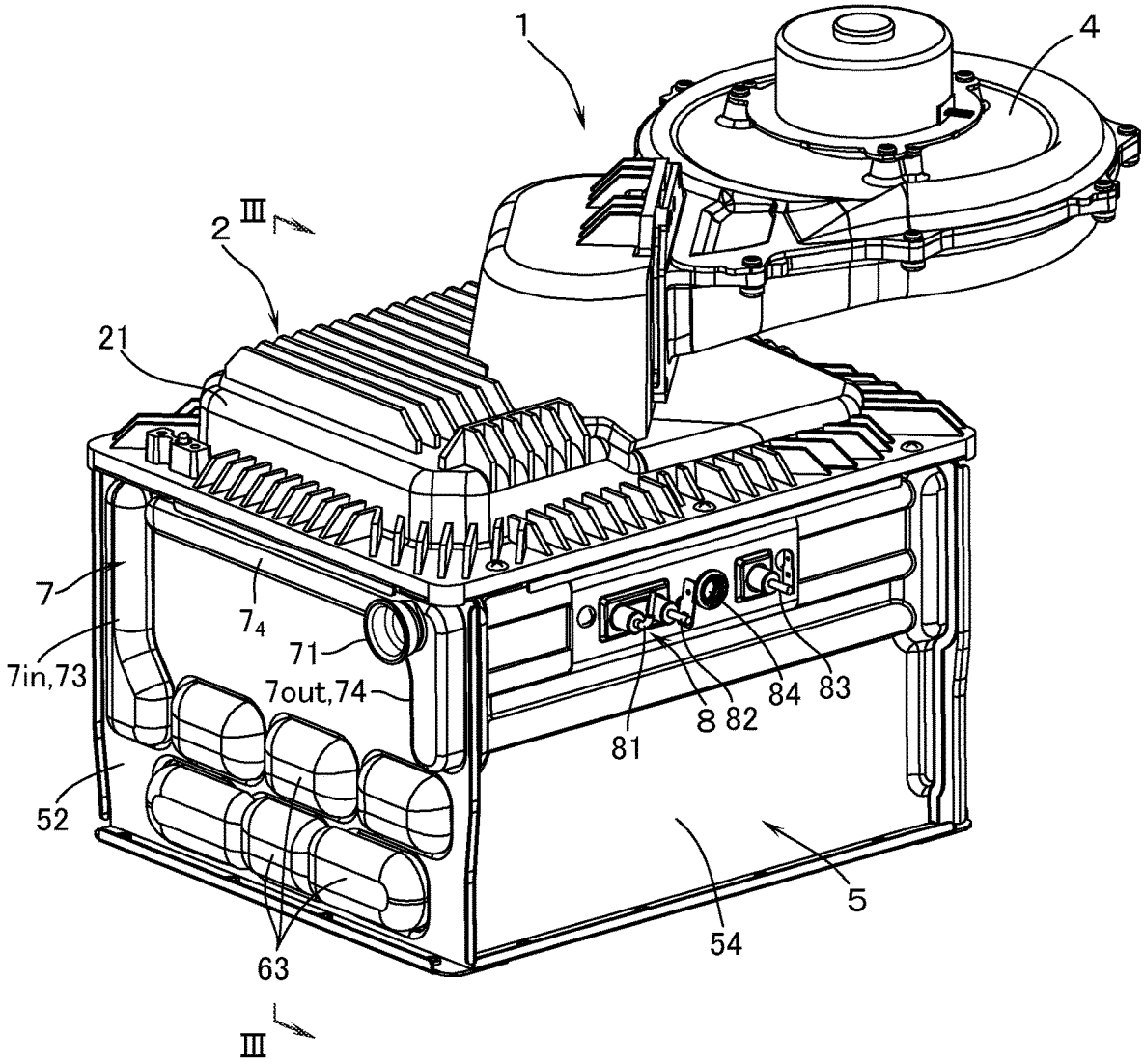
FIG. 1 is a perspective view of a combustion apparatus equipped with a burner according to a first embodiment of this invention.
Figure 2:
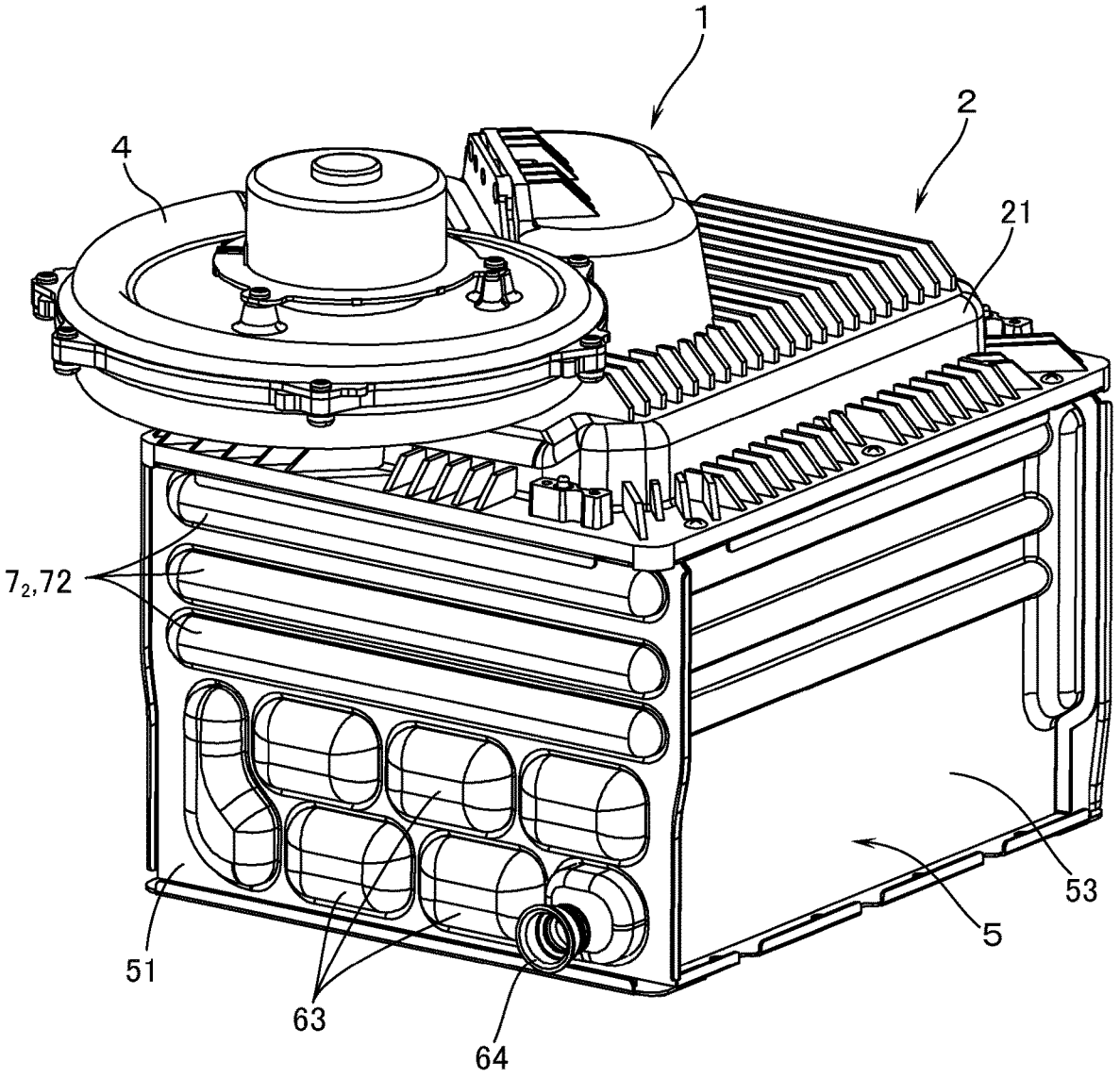
FIG. 2 is a perspective view of the combustion apparatus as viewed from a side opposite to that in FIG. 1.
Figure 3:
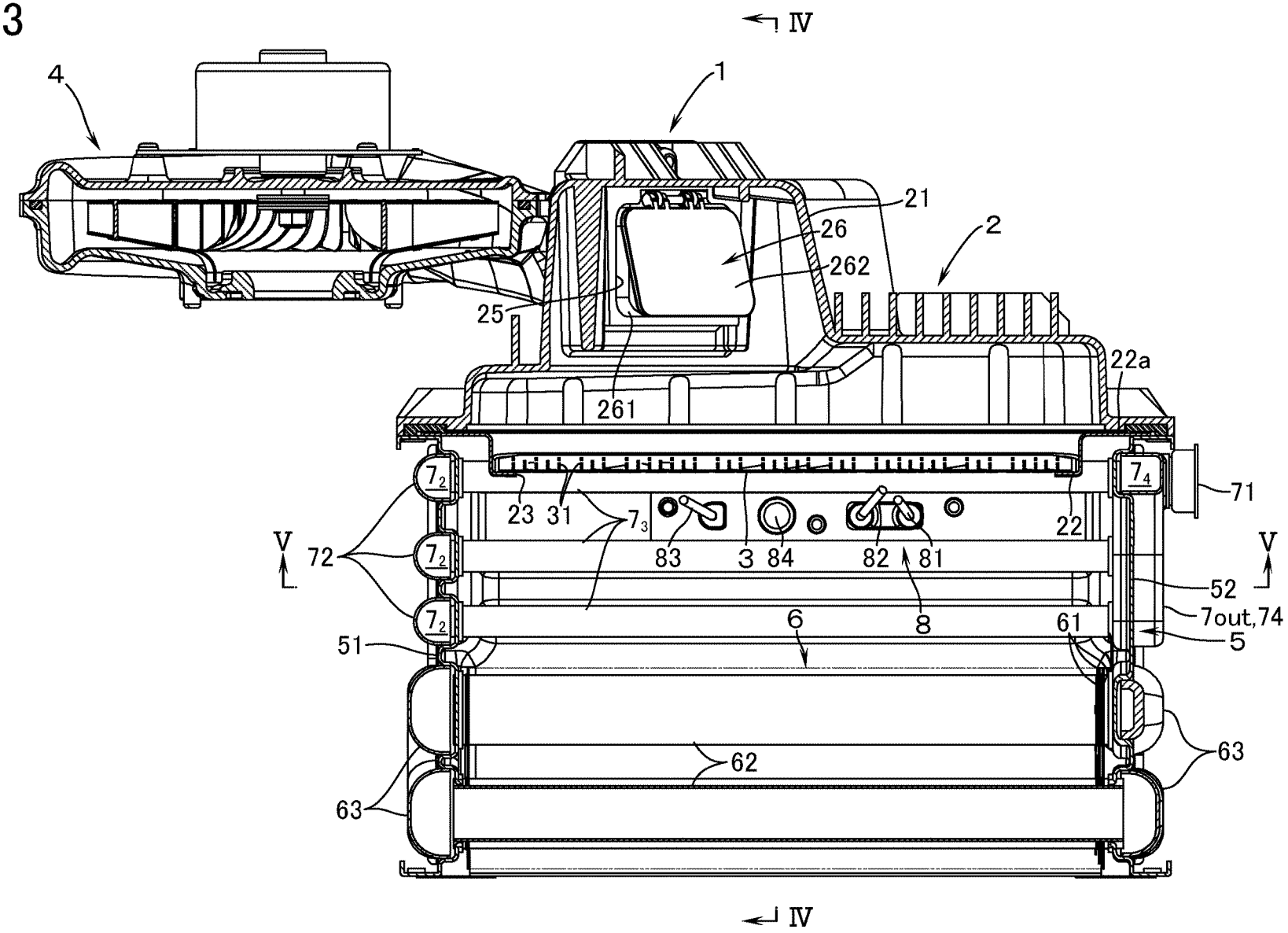
FIG. 3 is a sectional view cut away along the line III-III in FIG. 1.
Figure 4:
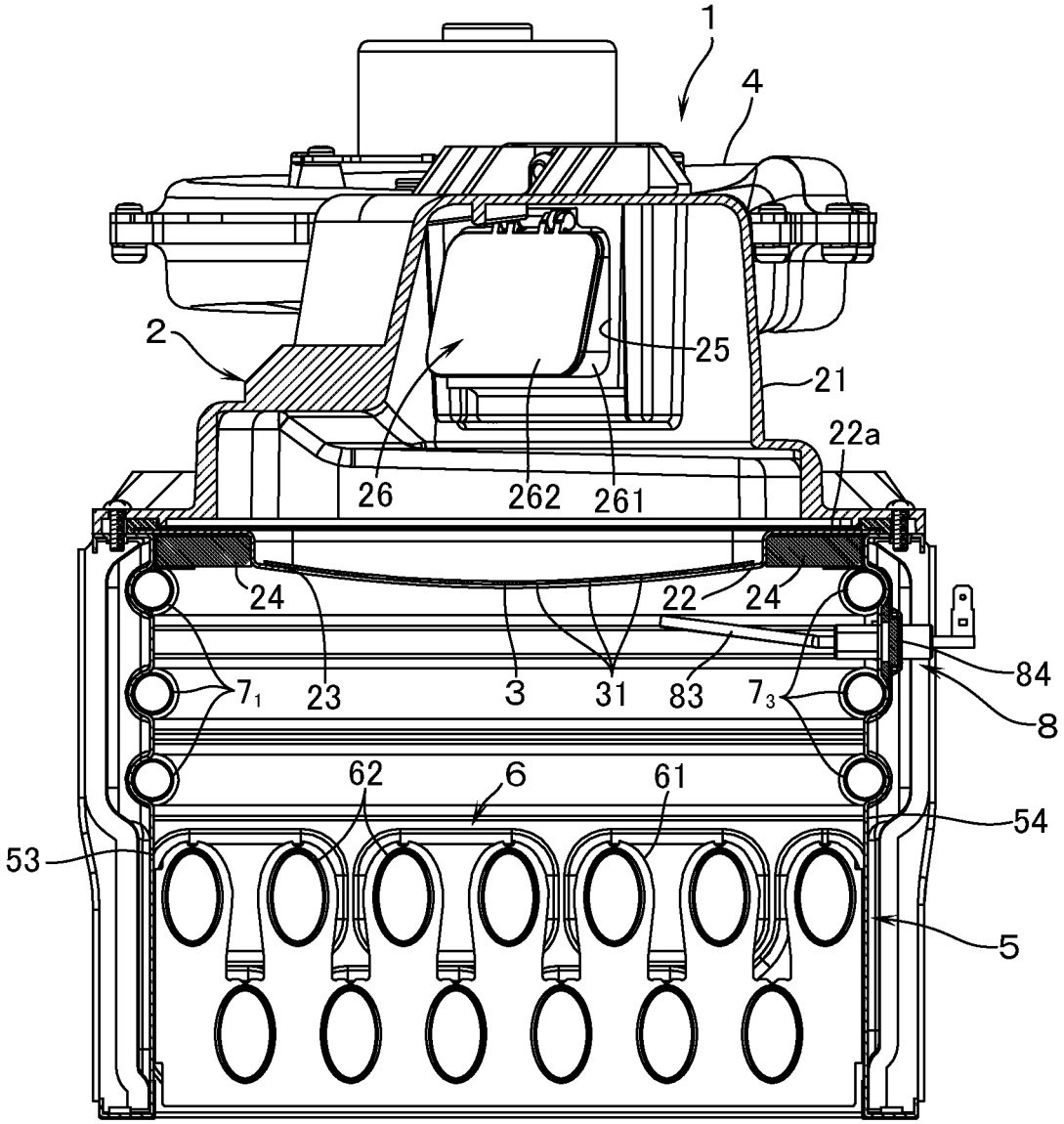
FIG. 4 is a sectional view cut away along the line IV-IV in FIG. 3.

FIGS. 1 through 4 show a combustion apparatus provided with a totally primary air combustion type of burner 1 according to an embodiment of this invention. The burner 1 is provided with a burner body 2 inside which air-fuel mixture (mixture gas of fuel gas and primary air) is supplied. The burner body 2 has: a main body 21 of a box shape and a lower surface thereof being left open; and a plate frame 22 which is of a picture frame shape and which is mounted on a lower surface of the main body 21 of the burner body 2. The central opening portion of this plate frame 22 constitutes an air-fuel mixture ejection part 23. The burner 1 is further provided with a combustion plate 3 which is of metallic plate make and which is mounted on the plate frame 22 in a manner to cover the air-fuel mixture ejection part 23 on the plate frame 22. In this arrangement, the air-fuel mixture is ejected downward out of a multiplicity of flame holes 31 formed in the combustion plate 3, to thereby perform totally primary air combustion (combustion requiring no secondary air). By the way, the plate frame 22 is a rectangle in outside shape. In a flanged part 22*a* around the periphery of the plate frame 22, a long side of the above-mentioned rectangle is provided with a thermal insulating material 24 on the lower surface thereof in order to restrain the thermal input to the burner body 2.

On an upper portion of the main body 21 there is formed an inlet port 25 which is connected to a fan 4 for supplying the air-fuel mixture. The inlet port 25 has mounted thereon a check valve 26 which prevents the air-fuel mixture that may remain inside the burner body 2 at the time of stopping of the fan 4, from flowing back to the side of the fan 4. The check valve 26 is constituted by: a valve box 261 which is of a resin make and which is fit into the inlet port 25; and a valve plate 262 which is of a resin make and which is mounted on that opening portion of the valve box which is directed toward the inside of the burner body 2 in a manner to be swingable for opening or closing.

The combustion apparatus is provided with a combustion box 5 which encloses the combustion space of the air-fuel mixture to be ejected out of the burner 1 and which is disposed on a lower side of the burner 1. In a lower portion of the combustion box 5 there is housed a heat exchanger 6 for supplying hot water, the heat exchanger being an object to be heated. The heat exchanger 6 is constituted by a fin-and-tube type of heat exchanger which is provided with a multiplicity of heat absorbing fins 61 disposed in parallel with one another, and a plurality of heat absorbing pipes 62 which penetrate through the heat absorbing fins 61.

Provided that the direction in which the heat absorbing fins 61 are disposed in parallel with one another is defined as a lateral direction, on an outside surface of a side plate 51 on lateral one side and a side plate 52 on the laterally opposite side, of the combustion box 5, there are disposed a plurality of connection lids (covers) 63 which define connection passages between the adjoining two heat absorbing tubes 62, 62 together with each of the side plates 51, 52. According to this arrangement, all the heat absorbing pipes 62 are connected in series with one another. In addition, there is disposed a water inlet port 64 in a connection cover 63 which defines a connection passage to be connected to the upstream-end heat-absorbing pipe 62 together with the side plate 51 on lateral one side.

In that portion of the combustion box 5 which lies between the burner 1 and the heat exchanger 6, there is disposed a water jacket 7 for cooling the combustion box 5. This water jacket 7 is constituted by: three sets of first jacket parts $\mathbf{7}_1$ which are disposed on a rear plate 53 of the combustion box 5 and which are made up of three water tubes elongated in a lateral direction arrayed in a vertical positional relationship; three sets of third jacket parts $\mathbf{7}_3$ which are made up of three water tubes elongated in a lateral direction arrayed in a vertical positional relationship and which are disposed on a front plate 54 of the combustion box 5; three sets of second jacket parts $\mathbf{7}_2$ which are disposed in a vertical positional relationship so as to be elongated in front to back direction and which are disposed on the side plate 51 on one lateral side of the combustion box 5 so as to connect together three sets of first jacket parts $\mathbf{7}_1$ and the three sets of third jacket parts $\mathbf{7}_3$; an inlet-side jacket part 7in which is elongated in the vertical direction, which is disposed in the rearward portion of the side plate 52 on the laterally opposite side of the combustion box 5, and which introduces the water passed through the heat exchanger 6 to the three sets of first jacket parts $\mathbf{7}_1$; and an outlet-side jacket part 7out which is elongated in the vertical direction and which is disposed in that portion of the combustion box 5 which is on a forward portion of the laterally opposite side of the combustion box 5, and into which the water from the third jacket parts $7_3$ flows. On an upper portion of the outlet-side jacket part 7out, there is disposed a hot water outlet port 71 to which is connected a hot water serving passage. According to this arrangement, the water (hot water) passing through the heat exchanger 6 flows from the inlet-side jacket part 7in through the first jacket parts $7_1$, the second jacket parts $7_2$, and the third jacket parts $7_3$ toward the outlet-side jacket part 7out, and is supplied from the hot water outlet port 71 to the hot water passage.

By the way, the second jacket parts $7_2$ are defined between the side plate 51 on one lateral side of the combustion box 5, and the cover plate 72 that has been attached to the side plate 51. Further, each of the jacket parts 7in, 7out on the inlet side and on the outlet side is also defined between the side plate 52 on the opposite side of the combustion box 5 and the cover plate 73, 74 that are mounted thereon. Further, a fourth jacket part $7_4$ that extends from an upper part of the outlet-side jacket part 7out backward, is disposed.

To the front plate 54 of the combustion box 5 there are mounted electrode parts 8 having an ignition electrode 81, a grounding electrode 82, and a flame rod 83. The ignition electrode 81, the grounding electrode 82, and the flame rod 83 are protruded toward the inside of the combustion box 5 so as to lie opposite to the combustion plate 3. Then, by means of spark discharging to be generated in a discharging gap between the ignition electrode 81 and the grounding electrode 82, the burner 1 is arranged to be ignited. By the way, the electrode parts 8 are provided with a peep window 84 to enable to visually recognize the inside of the combustion box 5.

Now, a detailed description will be made of the combustion plate 3 with reference to FIG. 5. The flame holes 31 to be formed in the combustion plate 3 are slit shaped. Provided that a longitudinal (longer-side) direction of the flame hole 31 is defined as an X-axis direction, and that a lateral (shorter-side) direction thereof is defined as a Y-axis direction, the combustion plate 3 has formed therein a plurality of flame-hole rows arrayed in the X-axis direction in parallel with one another, each of the flame-hole rows being constituted by a plurality of flame holes 31 arranged in the Y-axis direction at a predetermined pitch. As the flame-hole rows there are provided first flame-hole rows $32_1$, and second flame-hole rows $32_2$ in which a position of each flame hole 31 is offset in the Y-axis direction by half a pitch from the position of each flame hole 31 of the first flame-hole rows $32_1$. The first flame-hole rows $32_1$ and the second flame-hole rows $32_2$ are arranged alternately in the X-axis direction in parallel with one another.

Further, in a plurality of places in the Y-axis direction of one of the first flame-hole rows $32_1$ and the second flame-hole rows $32_2$ (second flame-hole rows $32_2$ in this embodiment), there are disposed thinned portions 33 in which one piece each of flame hole 31 is thinned (i.e., flame hole is not formed) so that the pitch between the flame holes 31, 31 becomes two times the above-mentioned predetermined pitch. Each of the thinned portions 33 is enclosed by a total of six flame holes constituted by: two flame holes 31, 31 belonging to the second flame-hole row $32_2$ in which the said thinned portion 33 is disposed, and also that are positioned on both sides, in the Y-axis direction, of the said thinned portion 33; two flame holes 31, 31 belonging to the first flame-hole row $32_1$ adjacent to one side, in the X-axis direction, of the second flame-hole row $32_2$ having disposed therein the said thinned portion, and also that are respectively deviated by half a pitch to both sides, in the Y-axis direction, relative to the center of the said thinned portion 33; and two flame holes 31, 31 belonging to the first flame-hole row $32_1$ adjacent to the opposite side, in the X-axis direction, of the second flame-hole row $32_2$ having disposed therein the said thinned portion 33, and also being respectively deviated by half a pitch to both sides, in the Y-axis direction, relative to the center of the thinned portion 33. Therefore, the air-fuel mixture to be ejected out of these six flame holes 31 will partly flow back to the thinned portion 33, whereby flame holding effect can surely be obtained.

Further, contrary to the conventional example in which some flame-hole rows are thinned, in this example, only one flame hole 31 is respectively thinned in a plurality of positions in the Y-axis direction of the second flame-hole rows $32_2$. Therefore, the air-fuel mixture will be ejected substantially uniformly out of the entire combustion plate 3. As a consequence, the air-fuel mixture will not be ejected concentrically within a limited region of the combustion plate 3, and the flame will not be enlarged even at the time of high intensity combustion. As a result, without increasing the distance between the burner 1 and the heat exchanger 6, which is an object to be heated, the flame will not come into contact with the heat exchanger 6. The combustion apparatus can thus be prevented from getting larger in size.

By the way, provided that such a portion of the combustion plate 3 as is overlapped with the air-fuel mixture ejection part 23 is defined as a combustion region, in a portion near a side edge on the outside, in the X-axis direction, of the combustion region, the heat will be deprived by the surrounding, resulting in a poor flame holding effect. As a solution, in this embodiment, an outside flame-hole row that is the flame-hole row near the side edge on an outside, in the X-axis direction, of the combustion region is arranged to be the first flame-hole row $32_1$ that is free from disposition of the thinned portions 33. According to this arrangement, the flame holding effect can be secured in a portion near the side edge on an outside, in the X-axis direction, of the combustion region. It is to be noted that the outside flame-hole row may be arranged to be the second flame-hole row $32_2$. In this case, the second flame-hole row $32_2$ that will become the outside flame-hole row will not be provided with thinned portions 33, unlike the other second flame-hole rows $32_2$.

Figure 5:
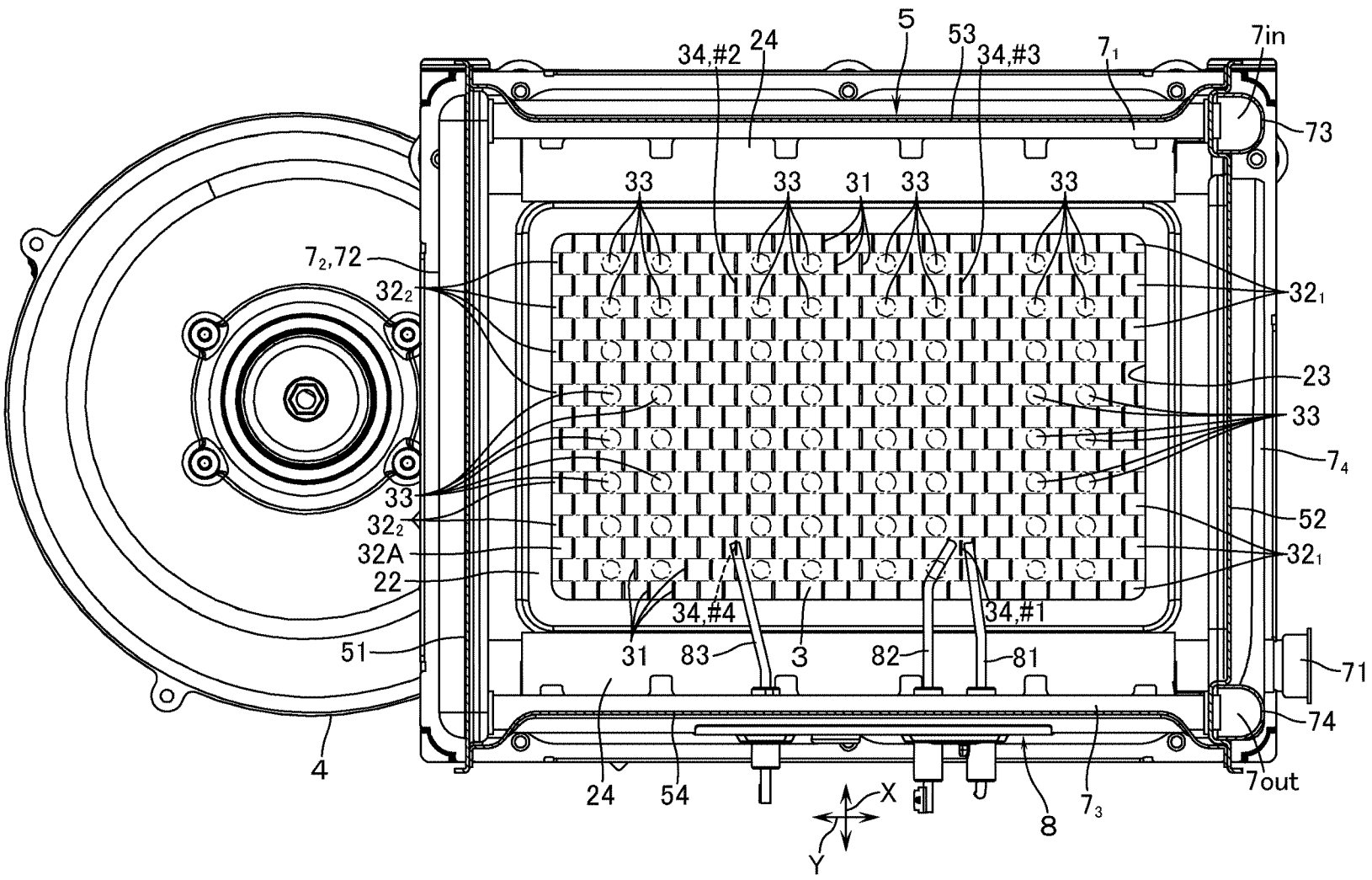
FIG. 5 is a sectional view cut away along the line V-V in FIG. 3.

Further, the discharging gap between the ignition electrode 81 and the grounding electrode 82 is arranged to face a predetermined portion between the flame holes 31, 31 that are not the thinned portion 33 and that belong to a specific flame-hole row 32A in one of the first flame-hole rows $32_1$ and the second flame-hole rows $32_2$ (in this embodiment, the first flame-hole row $32_1$ that is second from the bottom as shown in FIG. 5). An ignition flame hole 34 which is smaller than the flame hole 31 is disposed in the predetermined portion between the flame holes 31, 31. According to this arrangement, even if the position of the discharging gap may deviate to a certain degree, the air-fuel mixture from the ignition flame hole 34 can be supplied to the discharging gap. Therefore, ignition performance can be secured. Further, by making small the ignition flame hole 34, throwing off balance of the thermal distribution due to the addition of the ignition flame hole 34 can be prevented.

In this embodiment, the following are disposed: i.e., in addition to the #1 ignition flame hole 34 lying opposite to the discharging gap; a #2 ignition flame hole 34 which is in point-symmetry to the #1 ignition flame hole 34; and a #3 ignition flame hole which is in symmetry to the #1 ignition flame hole 34 relative to the X-axis direction; and a #4 ignition flame hole 34 which is in symmetry to #1 ignition flame hole 34 relative to the Y-axis direction. According to this arrangement, even if the combustion plate 3 is mounted on the plate frame 22 in an inverted posture in point of left-right or up-down relationship, any one of the ignition flame hole 34 will be lying opposite to the discharging gap. Therefore, the combustion plate 3 can be mounted in position without paying attention to the orientation thereof, resulting in an improvement in the ease of assembly work.

Figure 6:
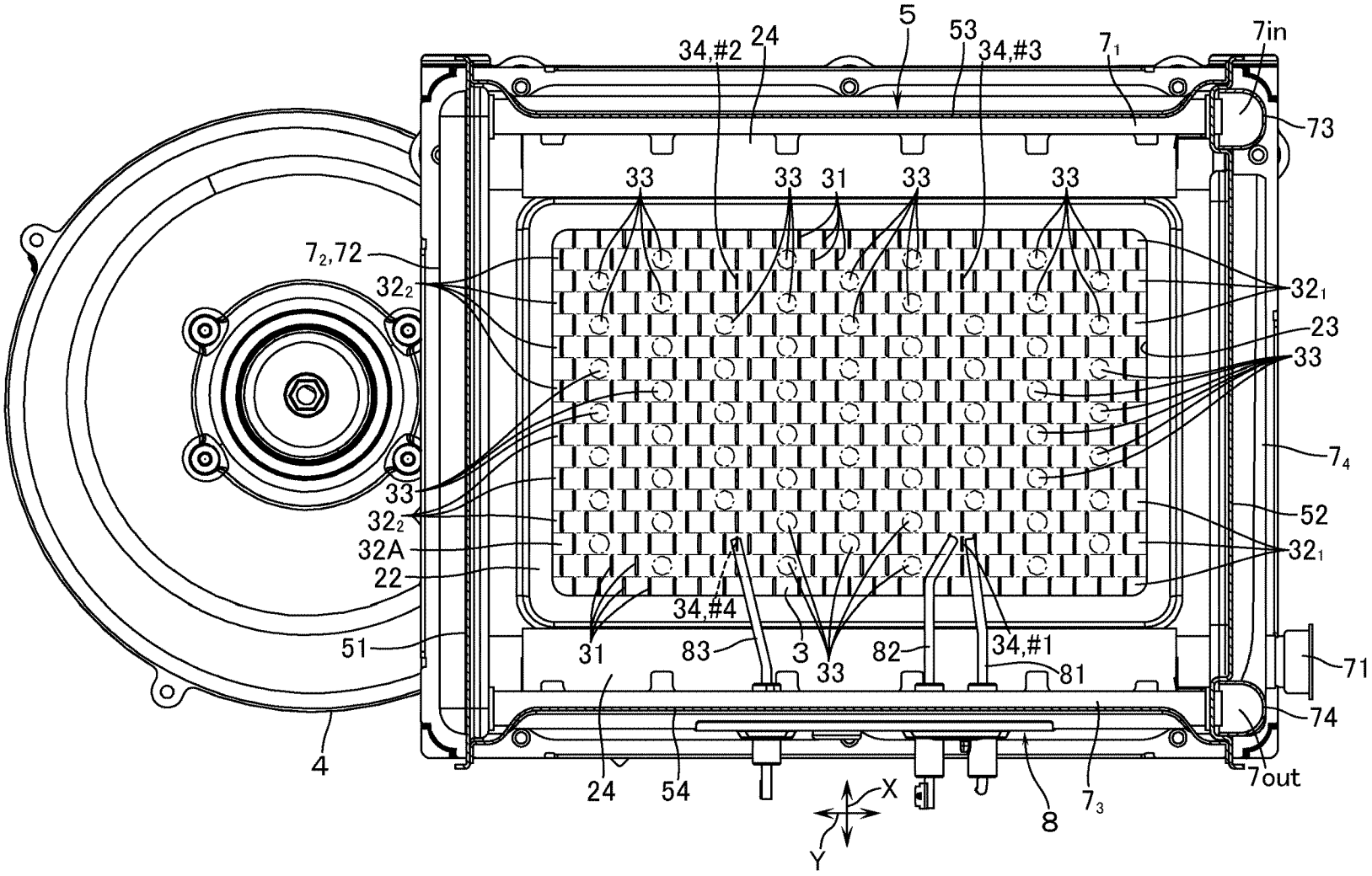
FIG. 6 is a sectional view, corresponding to FIG. 5, of a combustion apparatus equipped with a burner according to a second embodiment of this invention.

By the way, in the above-mentioned first embodiment, the thinned portions 33 are disposed only in the second flame-hole rows $\mathbf{32}_2$. However, as in the second embodiment shown in FIG. 6, the thinned portions 33 may be disposed in both the first flame-hole rows $\mathbf{32}_1$ and the second flame-hole rows $\mathbf{32}_2$. However, the positions of the thinned portions 33 disposed in the first flame-hole rows $\mathbf{32}_1$ shall be deviated in the Y-axis direction from the positions of the thinned portions disposed in the second flame-hole rows $\mathbf{32}_2$. Each of the thinned portions 33 disposed in the first flame-hole rows $\mathbf{32}_1$ is arranged to be enclosed by a total of six flame holes constituted by: two flame holes 31, 31 that belong to the first flame-hole row $\mathbf{32}_1$ in which the said thinned portion 33 is disposed, and that are positioned on both sides, in the Y-axis direction, of the said thinned portion 33; two flame holes 31, 31 that belong to the second flame-hole row $\mathbf{32}_2$ adjacent to one side, in the X-axis direction, of the first flame-hole row $\mathbf{32}_1$ in which the said thinned portion 33 is disposed, and that are respectively deviated in the Y-axis direction by half a pitch relative to the center of the said thinned portion 33; and two flame holes 31, 31 that belong to the second flame-hole row $\mathbf{32}_2$ adjacent to the opposite side, in the X-axis direction, of the first flame-hole row $\mathbf{32}_1$ in which the said thinned portion 33 is disposed, and that are respectively deviated by half a pitch to both sides, in the Y-axis direction, relative to the center of the said thinned portion 33. Further, each of the thinned portions 33 disposed in the second flame-hole row $\mathbf{32}_2$ is arranged to be enclosed by a total of six flame holes 31 constituted by: two flame holes 31, 31 that belong to the second flame-hole row $\mathbf{32}_2$ in which the said thinned portion 33 is disposed, and that are positioned on both sides, in the Y-axis direction, of the thinned portion 33; two flame holes 31, 31 that belong to the first flame-hole row $\mathbf{32}_1$ adjacent to one side, in the X-axis direction, of the second flame-hole row $\mathbf{32}_2$ in which the said thinned portion 33 is disposed, and that are respectively deviated by half a pitch to both sides, in the Y-axis direction, relative to the center of the said thinned portion 33; and two flame holes 31, 31 that belong to the first flame-hole row $\mathbf{32}_1$ adjacent to the opposite side, in the X-axis direction, of the second flame-hole row $\mathbf{32}_2$ in which the said thinned portion 33 is disposed, and that are respectively deviated by half a pitch to both sides, in the Y-axis direction, relative to the center of the said thinned portion 33. According to this arrangement, an effect similar to that of the first embodiment can be attained.

Figure 7:
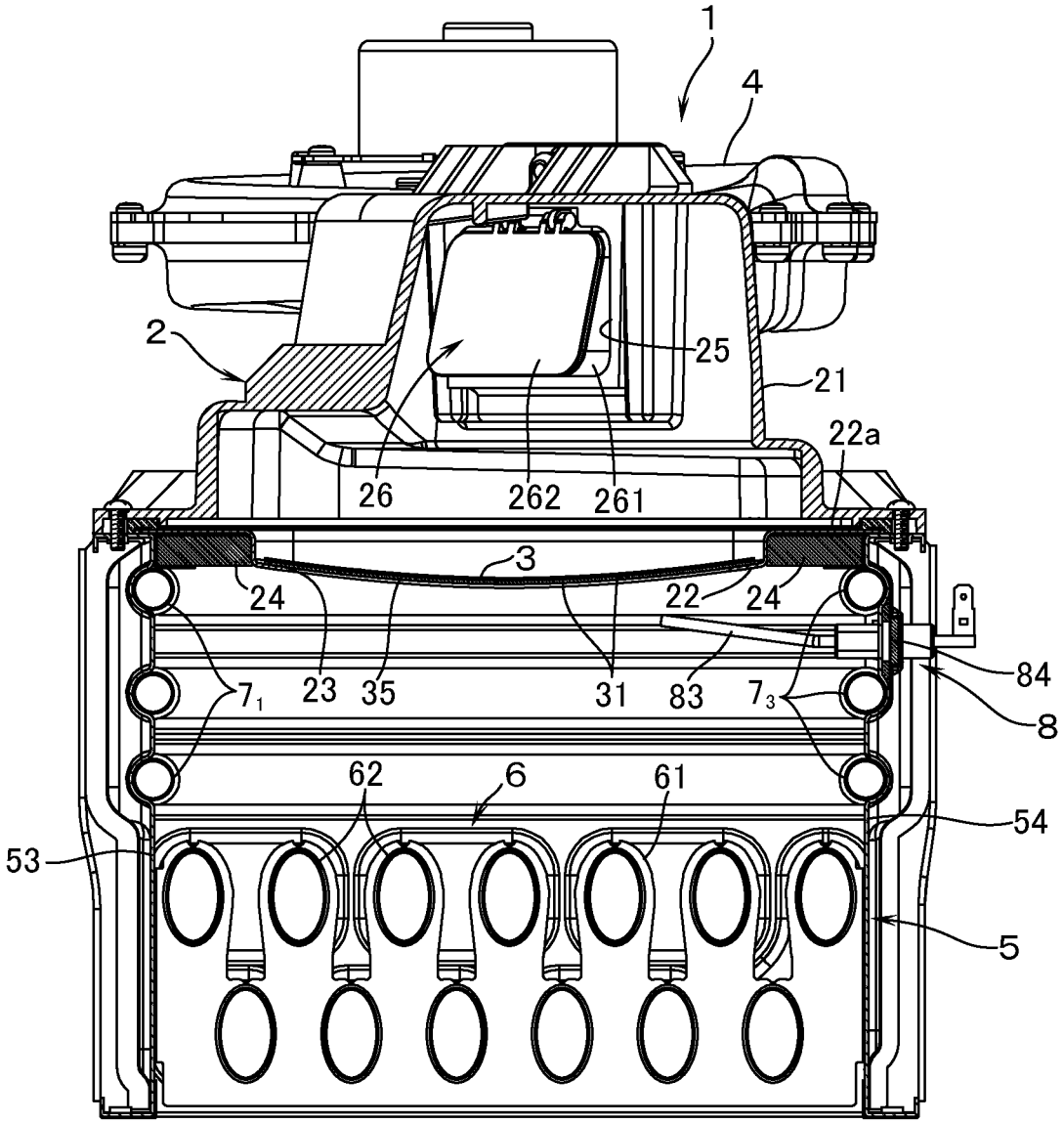
FIG. 7 is a sectional view, corresponding to FIG. 4, of a combustion apparatus equipped with a burner according to a third embodiment of this invention.

Next, description will be made of a third embodiment with reference to FIG. 7. The difference of this third embodiment from the first and the second embodiments is that a heat resistant fabric 35 that is woven with heat resistant fibers which are metallic fibers or the like is overlapped with that surface of the combustion plate 3 to which air-fuel mixture is ejected.

In the third embodiment, the air-fuel mixture will be ejected out of the flame holes 31 through the heat-resistant fabric 35. Therefore, the velocity distribution of the ejected air-fuel mixture in the Y-axis direction with the flame hole 31 serving as the center, becomes gradual. As a result, a very small flame will be formed also in the thinned portions 33 in the first and the second embodiments. According to this arrangement, the flame holding effect can be increased and the lifting resistance of the flames can be improved.

Descriptions have so far been made of embodiments of this invention, but this invention shall not be limited to the above. For example, in the above-mentioned first embodiment, the positions in the Y-axis direction of the thinned portions 33 are identical in all of the second flame-hole rows $\mathbf{32}_2$. It may, however, be so arranged that the position, in the Y-axis direction, of the thinned portion 33 may be varied for each of the second flame hole rows $\mathbf{32}_2$. Further, in the above-mentioned embodiments, this invention was applied to the burner 1 which ejects the air-fuel mixture in a downward direction. However, this invention is also similarly applicable to the burner which ejects the air-fuel mixture upward.

EXPLANATION OF MARKS

1 burner
2 burner body
23 air-fuel mixture ejection portion
3 combustion plate
31 flame hole
$\mathbf{32}_1$ first flame-hole row
$\mathbf{32}_2$ second flame-hole row
32A specific flame-hole row
33 thinned portion
34 ignition flame hole
35 heat-resistant fabric
81 ignition electrode
82 grounding electrode

What is claimed is:

1. A totally primary air combustion type of burner which is provided with a combustion plate to cover an air-fuel mixture ejection part of a burner body, and in which air-fuel mixture is ejected for combustion out of a multiplicity of slit-shaped flame holes formed in the combustion plate, provided that a longitudinal direction of each flame hole is defined as an X-axis direction, and that a lateral direction thereof is defined as a Y-axis direction, the combustion plate has a plurality of flame-hole rows, each row being constituted by a plurality of flame holes arranged in the Y-axis direction at a predetermined pitch, the plurality of flame-hole rows being arrayed in the X-axis direction in parallel with one another, wherein the flame-hole rows are made up of first flame-hole rows, and second flame-hole rows with a position of each flame hole being offset in the Y-axis direction by half a pitch from the position of each flame hole of the first flame-hole rows, the first flame-hole rows and the second flame-hole rows being arranged alternately in the X-axis direction in parallel with one another, wherein at least one of the first flame-hole rows and the second flame-hole rows has, in a plurality of places in the Y-axis direction, thinned portions in which one piece each of flame hole is thinned so that the pitch between the flame holes becomes two times the predetermined pitch, and wherein each of the thinned portions is enclosed by a total of six flame holes, which are within at least three adjacent flame-hole rows, constituted by:

two flame holes belonging to the flame-hole row in which the said thinned portion is disposed, and also positioning on both sides, in the Y-axis direction, of the said thinned portion;

two flame holes belonging to a flame-hole row positioned on one side, in the X-axis direction, of the flame-hole row in which the said thinned portion is disposed, and also being respectively deviated by half a pitch to both sides, in the Y-axis direction, relative to a center of the said thinned portion; and two flame holes belonging to a flame-hole row positioned on an opposite side, in the X-axis direction, of the flame-hole row in which the said thinned portion is disposed, and also being respectively deviated by half a pitch to both sides, in the Y-axis direction, relative to the center of the said thinned portion.

2. The totally primary air combustion type of burner according to claim 1, provided that such a portion of the combustion plate as is overlapped with the air-fuel mixture ejection part is defined as a combustion region, and that, out of the first flame-hole rows and the second flame-hole rows, the flame-hole row that is near a side edge on an outside, in the X-axis direction, of the combustion region is defined as an outside flame-hole row, wherein the outside flame-hole row is free from disposition of the thinned portions.

3. The totally primary air combustion type of burner according to claim 1, wherein a discharging gap between those ignition electrode and grounding electrode which are disposed to face the combustion plate lies opposite to that predetermined portion between the flame holes which belongs to one of the first flame-hole rows and the second flame-hole rows and which is other than the thinned portion, and wherein an ignition flame hole which is smaller than the flame holes is disposed in the predetermined portion between the flame holes.

4. The totally primary air combustion type of burner according to claim 1, wherein a heat-resistant fabric is laminated on a surface of that side of the combustion plate out of which the air-fuel mixture is ejected.

* * * * *